United States Patent [19]

Balaskas

[11] Patent Number: 4,510,973

[45] Date of Patent: Apr. 16, 1985

[54] HYDRAULIC CONTROL VALVES

[75] Inventor: Spyros Balaskas, Bremen, Fed. Rep. of Germany

[73] Assignee: Vereinigte Flugtechnische Werke GmbH, Bremen, Fed. Rep. of Germany

[21] Appl. No.: 446,200

[22] Filed: Dec. 2, 1982

[30] Foreign Application Priority Data

Dec. 18, 1981 [DE] Fed. Rep. of Germany ..... 3150252

[51] Int. Cl.[3] ..... F15B 13/06

[52] U.S. Cl. ..... 137/625.64; 91/536; 137/596.18; 137/625.6

[58] Field of Search ..... 91/513, 536; 137/596.14, 596.16, 596.18, 625.6, 625.64

[56] References Cited

U.S. PATENT DOCUMENTS 4,368,750 1/1983 Burton ..... 137/625.64 X

FOREIGN PATENT DOCUMENTS 1167703 10/1969 United Kingdom ..... 137/625.64

OTHER PUBLICATIONS

Sperry Vickers Article of Jan. 1979.

*Primary Examiner*—Gerald A. Michalsky
*Attorney, Agent, or Firm*—Ralf H. Siegemund

[57] ABSTRACT

The hydraulic control valve as described includes two precontrol valves, each of them capable of operating the valve slide element in a primary control fashion while the respective other of the precontrol valve performs auxiliary functions so that in total two sets of outputs can be controlled whereby in each case the secondary control function can be carried out persistently or intermittently for the duration of persistence of the primary control function.

7 Claims, 5 Drawing Figures

HYDRAULIC CONTROL VALVES

BACKGROUND OF THE INVENTION

The present invention relates to a control valve for hydraulic actuators or the like and including a valve casing or housing having a bore for receiving a valve slide element which in turn is subject to control of precontrol or actuator valves or the like.

Control valves of the type to which the invention pertains, are generally known and they are used primarily for controlling hydraulic actuators such as cylinders or the like. In these valves one employes a valve slide having annular ridges cooperating with annular grooves in the bore of the housing or casing for purposes of providing passing and/or no passing flow conditions. Upon shifting the valve slide, therefore, flow passages for the hydraulic fluid are either opened or blocked. Instrumental here are particularly the control edges as they are defined by the annular ridge or ridges in the slide and the groove or grooves in the casing or housing.

Hydraulic control valves are known which are also called four/three path valves. Such valves are usually moved into the desired control position by means of two electrically controlled precontrol valves. In this case one provides one precontrol valve per defined control position of the principal control valve in order to obtain two particular control positions of the slide. A third position is attained when none of the two precontrol valves are actuated which constitutes the idle normal or resting state. The two precontrol valves can be controlled only mutually exclusively which means that upon actuating one of the precontrolled valves the other one cannot be actuated. This however, is a drawback for the principal reason that at no time should a controlled or control element be subject to nonactuation i.e. effectively eliminated from the arrangement.

DESCRIPTION OF THE INVENTION

It is an object of the present invention to provide a new and improved control valve which is free from the limitations of the prior art valves as described above, and which, in particular, can be used for performing supplemental or additional control functions.

It is a particular object of the present invention to improve hydraulic control valves constructed to have a valve case with a bore receiving a slidable valve element, the position of which is controlled by precontrol valves and wherein grooves in the bores and ridges on the slide element cooperate for opening and closing predetermined passages in a manner which depends upon the axial disposition of the slide element.

In accordance with the preferred embodiment of the present invention, it is suggested to provide a control valve having a housing which in turn is provided with a bore for receiving a slide element capable of attaining different axial position therein, and wherein a central portion of the slide element is provided with three annular ridges cooperating with corresponding annular grooves in the bore. The bore and the grooves thereof, are particularly connected to a source of higher pressure (e.g. operating pressure) and to a source of lower pressure such as a venting opening; the casing is additionally provided with a pair of output ducts which are respectively connected to the source of higher and the source of lower pressure, but the connection pattern is dependent upon the particular axial disposition and deflection of the valve slide element from the neutral position, in the latter position none of the output ducts is connected to either source of pressure. The slide element is biased towards a central disposition by means of two springs acting respectively upon the ends of the slide element. The ends of the slide element moreover are constructed as pistons and are e.g. provided with bores. These bores respectively cooperate with two groups of bores in the housing or case adjacent the ends of the slide element and each of these duct or bore groups includes a precontrol valve. Depending upon which one of the two precontrol valves is actuated, hydraulic pressure is applied through the ducts as one of the ends of the slide elements to cause a piston effect for shifting the slide element in one direction; actuation of the other precontrol valve to the (initial) exclusion of the former will cause the slide element to be shifted into the opposite direction. However, when in one or the other of the two shifted positions of the slide element, the respective other precontrol valve can also be actuated and this way at least one additional output duct is provided with operating pressure, in other words, each of the two precontrol valves can operate as a primary precontrol valve causing the slide element to be placed into one or the other limit position. Thereafter actuation of the respective other precontrol valve permits the carrying out of additional valving function which may be dependent upon the previously attained shifted disposition of the valve slide element. Moreover, during the persistant actuation of one of the precontrol valves, serving at that point as a primary control element for the control valve, the other precontrol valve can be controlled persistently or intermittently, which adds to the versatility of the system.

Basically, two versions are suggested; in one version an auxiliary pair of output ducts are provided of which one received operating pressure by the respective secondary precontrol valve while the respective other supplemental output duct receives a lower pressure; the selection depends upon the disposition of the slide element which is, of course, dependent upon the selection of the primary precontrol valve. The selection determines which one of the two supplemental output ducts receives operating pressure and which one receives a lower venting pressure. In the second version, a single supplemental output duct is provided which will receive higher operating pressure through either of the two precontrol valves when operated as a secondary valve while venting is not provided for for this secondary and auxiliary output system, because for example, the device connected the one auxiliary output has its own venting system.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof, will be better understood from the following description taken in connection with the accompanying drawings in which:

DETAILED OF THE DRAWINGS

Figure 1:
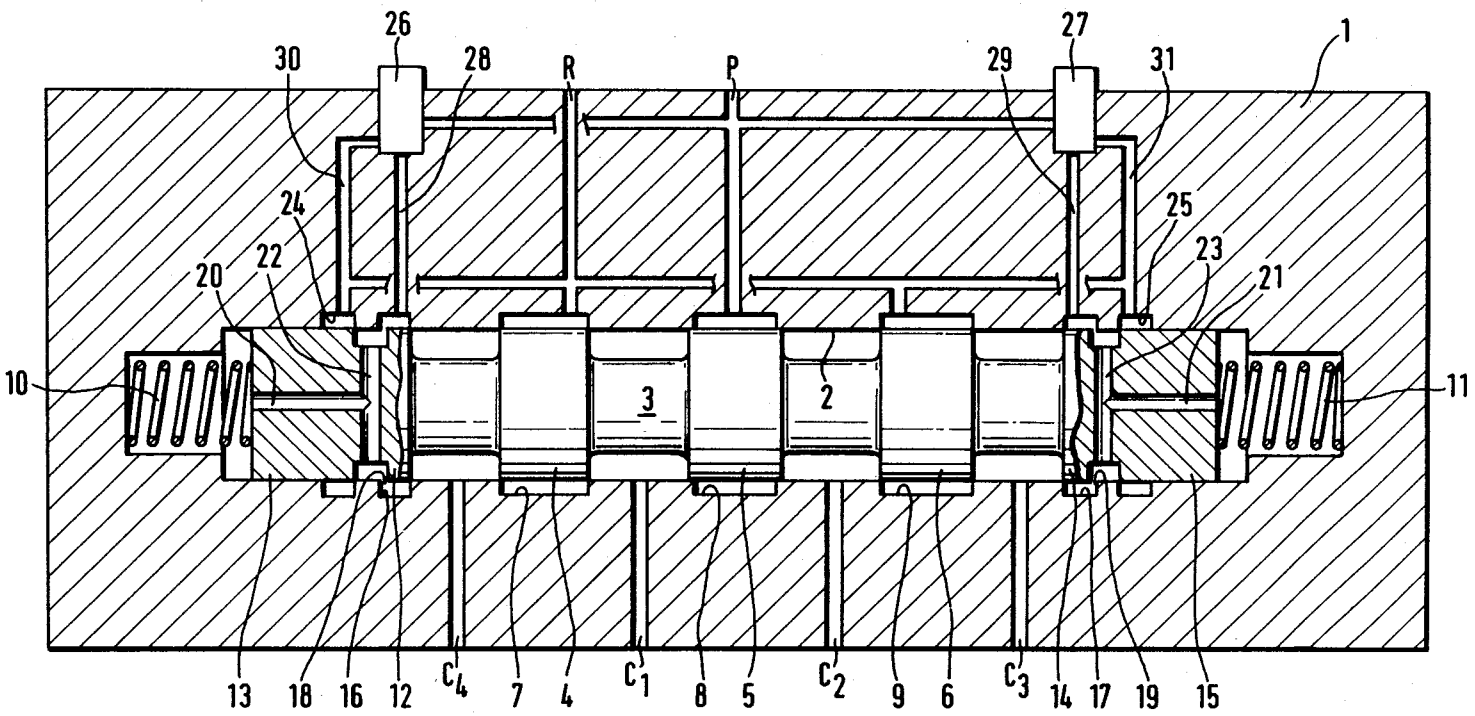
FIG. 1 is a longitudinal section view through a valve in accordance with the preferred embodiment of the present invention for practicing the best mode thereof.

FIG. 1 illustrates a valve casing or housing 1 having a central bore 2 which receives a valve slide element 3. The valve slide 3 is provided in its central portions with three annular ridges 4, 5, and 6. These ridges 4, 5, and 6 are respectively associated with annular grooves 7, 8, and 9 in the bore 2. The middle ring groove 8 is connected to a duct to which a supply or operating pressure P is provided i.e. that particular duct is connected to a pressurized source of hydraulic fluid having the pressure P. The two other grooves 7 and 9 are interconnected by means of ducts in the housing or casing 1 and together they connect to the low pressure or venting return path R leading back to the source of hydraulic fluid, e.g. for repressurization. The usual valve case is provided with output ducts C1, C2, C3 and C4 being respectively disposed between the annular grooves 7 and 8; 8 and 9; 9 and 17; and 7 and 16 on the other hand. These ducts C1 and C2 are the primary output ducts, and ducts C3 at C4 are secondary ones.

The valve slide element 3 is centered by means of two pressure springs 10 and 11 acting upon the slide on opposite ends. Moreover, the slide 3 is provided with additional annular ridges namely 12 and 13 near the one end acted upon by spring 10, and ridges 14 and 15 are provided near the end acted upon by spring 11. The two annular ridges 14 and 12 are more inwardly disposed, and as far as axial dimensions are concerned they are smaller than two respectively associated annular grooves 16 and 17 in the bore 2. The ridges 13 and 15 are actually the ends proper of element 3, and they constitute pistons, being movably disposed in chambers into which extend the springs 10 and 11.

When in resting position, i.e. in the idle state, the valve slide 3 has a disposition in which the control edges of the ridges 12 and 14 face radially the annular grooves 16 and 17 while the respective other i.e. axially oppositely oriented control edges of the two annular ridges 12 and 14 respectively leave annular gaps 18 and 19. The valve slide ends 13 and 15 are respectively provided with longitudinal bores 20 and 21 respectively terminating at the piston chambers. These bores extend up to the transverse bores 22 and 23 respectively and are provided to extend diagonally to opposite points in the grooves between the two annular ridges 12 and 13 on one hand and 14 and 15 on the other hand. The two annular ridges or pistons 13 and 15 establishing the two ends of the valve slide 3 are considerably larger axially than respectively associated annular grooves 24 and 25 in the bore 2. However, they can be as short as these grooves but not shorter.

The valve slide 3 is shifted and is placed by means of precontrol valves 26 and 27 having inputs connected to ducts leading to the supply pressure P. The outputs of these precontrol valves lead respectively through ducts 28 and 29 to the annular grooves 12 and 17. Furthermore, the precontrol valves 26 and 27 are connected through their leakage exits and through respective ducts 30 and 31 to the low pressure return R. Moreover, the duct 30 and 31 are connected to the annular grooves 24 and 25 to connect the latter to the return R accordingly.

The valve illustrated in FIG. 1 operates as follows: the position of the main valve is determined by the two precontrol valves 26 and 27. Upon electrically energizing precontrol valve 26 supply pressure is applied via this valve to the annular groove 16. In view of the gap 18, the supply pressure is in fact applied through the transverse bore 22 and the longitudinal bore 20 into the cavity otherwise occupied by this spring 10. Therefore, pressure acts on piston 13 and the valve slide is moved to the right against the force of spring 11. As a consequence, the supply pressure P is applied through the now opened annular groove 8 to the output duct C1. Concurrently, the output duct C2 is conductively connected to the return R via the annular groove 9.

Figure 3A:
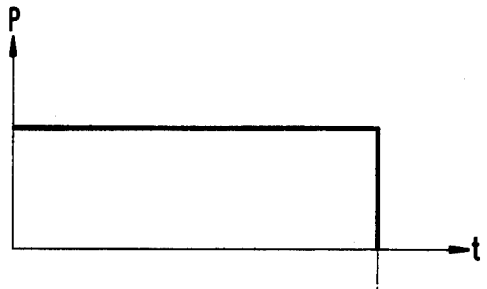
FIGS. 3*a*, 3*b*, and 3*c* are three signal diagrams plotted in vertical alignment for demonstrating the operation involved in the valves in accordance with the present invention.

FIG. 3*a* is a diagram from which one can see that the supply pressure remains effective for a particular period of time indicated by $t_1$. Within this period of time $t_1$ it is well permissible to control also the other control valve, namely 27. In such a case the output duct C3 will in fact be connected to the supply pressure P while the output duct C4 is connected to the return R due to the adjusted portion of the slide 3. This connection is effective whenever valve 26 is the primary precontrol valve and actuated accordingly.

Figure 3B:
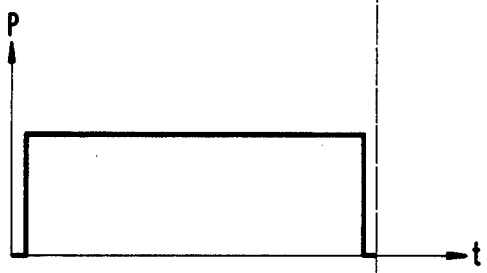
Figure 3C:
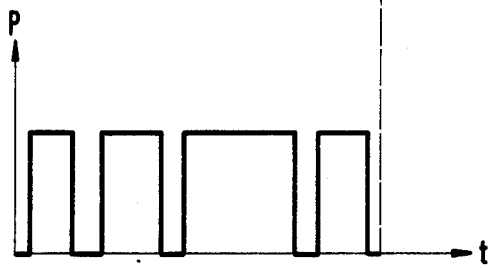

It can readily be seen that between the output C3 and C4 one could provide another actuator or valve. The control of the second precontrol valve 27 within the period $t_1$ and while the first valve 26 remained actuated, can be of persisting duration as schematically shown in FIG. 3*b* showing a slightly shortened period of time for the actuation of the second precontrol valve 27. On the other hand, the second precontrol valve 27 can be actuated intermittently with possibly irregular duration of each of the brief actuations. This is illustrated in the diagram of FIG. 3*c*.

The situation is different if the precontrol valve 27 is the one that is being controlled first. In this case the valve slide 3 is moved to the left so that the hydraulic supply pressure P is applied to the output duct C2 while the return R is connected to the exit C1. If subsequently the precontrol valve 26 is actuated, either persistently or intermittently, then the supply pressure P is connected to the output duct C4 and the return path R is connected to the output duct C3. Thus, it can readily be seen that the inventive control valve uses always both of two precontrol valves so as to make the overall operating state and operating result dependent upon the combination sequence of precontrol valve operation, or one can say the overall operating state is determined by which one of the precontrol valves is used as the primary control valve and which one is used as a secondary control valve. The role attributed to each is determined by the selection and sequence of initial and subsequent and subsequence energization. In either case, one can provide additional outputs and connect the main valve to an additional actuator and/or an other control valve or the like.

Figure 2:
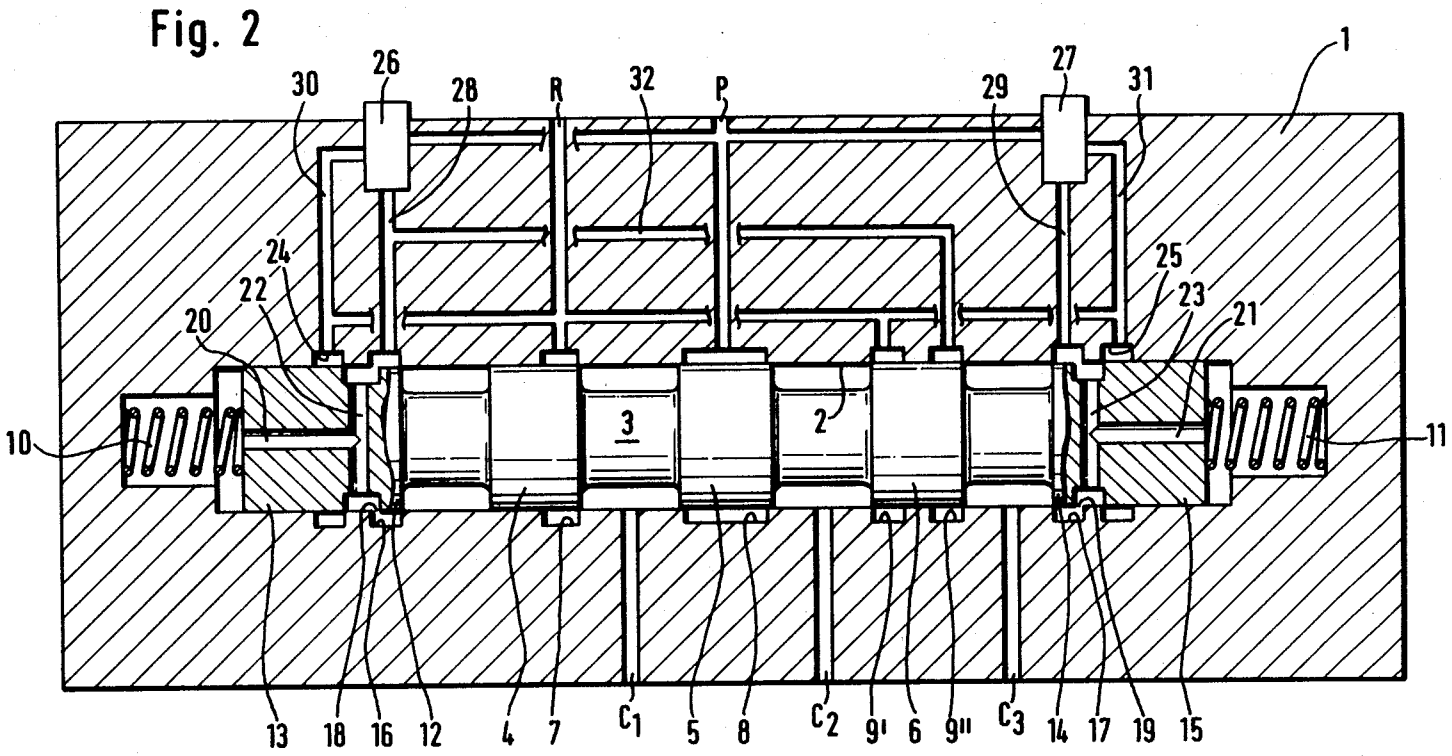
FIG. 2 is a similar section view through another example of the preferred embodiment of the present invention adapted for a different set of control functions.

The control valve illustrated in FIG. 2 has most of the components described with reference to FIG. 1, except that the output duct C4 has been eliminated and the groove 9 in FIG. 1 has been, so to speak, divided into two annular grooves 9' and 9'' in the bore 2. The annular groove 9' fulfills the same tasks the groove 9 does in the example of FIG. 1. The additional annular groove 9'' is connected to the duct 28 by means of a duct 32. The duct 28 is connected to the output side of the precontrol valve 26 as before. Thus, valve 26 controls the pressure in groove 16 and in groove 9".

As far as the control function involving the outputs C1 and C2 is concerned, it is identical with the control function provided for with the valve in accordance with FIG. 1. Depending upon utilization of the precontrol valve 27 or the precontrol valve 26 as primary input, either output C1 or output C2 is connected to the supply pressure while the respective other output is connected to the return R. After, for example, the valve 27 has been actuated as primary input device the precontrol valve 26 can be used to provide a continuous or intermittent control functions as described. In such a case, supply pressure is provided to the annular groove 9" via the ducts 28 and 32. Due to the shifted portion of the valve slide to the left the groove 9" is conductively connected to the output C3. This output C3 is provided only for supplying pressure to one input for an actuator which should be provided by itself with means for venting. If valve 26 acts as primary control valve causing slide 3 to be shifted to the right, groove 17 is connected to output C3 and valve 27 acts as secondary control valve.

It can readily be seen that both examples for the inventive control valve permit the utilization of supplementary or secondary control functions after a primary control function has been provided, whereby each of the precontrol valves can act as the primary control element while the other one acts as secondary control valve.

The invention is not limited to the embodiments described above, but all changes and modifications thereof, not constituting departures from the spirit and scope of the invention are intended to be included.

I claim:

1. Hydraulic control valve comprising:

a housing having a cylindrical bore;

a valve slide element disposed in the bore having three more centrally positioned control ridges, said bore having annular grooves radially aligned with said control ridges of said slide element when in a central position;

duct means for providing a first pressure to a middle one of the three annular grooves;

duct means for providing a second pressure different from the first pressure to the two other ones of the two annular grooves;

a pair of spring means acting upon opposite ends of the slide element tending to position it into said central and neutral position;

the ends of the control slide element acting as pistons and being provided with ducts;

two groups of ducts in the housing connected to the higher one of the two pressures;

two independently operable precontrol valves respectively included in respective paths for the two groups of ducts respectively for controlling application of the higher one of the two pressures through the ducts of the group;

additional grooves in said bore cooperating with additional ridges on said slide element adjacent to the ducts at the ends thereof, such that upon actuation of one of the precontrol valves the higher one of the two pressures is applied to be effective in the ducts at the particular end of the slide element to be effective as piston for shifting the slide element to one side while the other one of the two precontrol valves remains inactive, the latter of the two precontrol valves when actuated while the former precontrol valve is inactive causing analogously the slide element to be shifted to the other side;

a pair of principal output ducts in the housing and being connected to the two sources of pressure via said three more centrally disposed annular grooves in the bore and in an order depending upon whether the slide element has been shifted to one side or to the other side; and additional output duct means in the housing and being effectively connected to the source of the higher pressure upon actuation of one of the precontrol valves after the respective other one has been and remains actuated, there being passages including said bore and being respectively opened by shifting of the slide element upon actuation of the one precontrol valve to permit control of pressure application to the additional output duct means by the respective one control valve.

2. A control valve having a housing being provided with a bore further having a pair of input ducts being under different pressure and leading to said bore, and still further having a second pair of output ducts there being a slide element slidably disposed in the bore the improvement comprising:

central portions of the slide element and of the bore being constructed for causing the first pair of ducts to be conductively connected to the second pair of ducts at an order depending upon the axial position of the slide element;

the ends of the slide element being constructed as pistons;

means including a pair of precontrol valves included in the control valve housing and constructed for providing actuating pressure to the slide element for shifting it axially to one side or the opposite side depending upon which one of the precontrol valves is actuated thereby disabling the respective other precontrol valve from applying pressure for shifting the slide element in the opposite direction; and additional duct means including a secondary output receiving particular pressure conditions upon actuation of one of the precontrol valves as a secondary valve, depending upon the previously attained axial position of the slide element and further dependent upon actuation of one of the precontrol valves as primary control element.

3. A valve as in claim 2 wherein the secondary output is provided as a pair of output ducts respectively disposed adjacent the two ends of the slide element so that in one axial position of the slide element, one of the two additional output ducts receives a higher pressure and the other one lower pressure and upon operation of the respective other one of the precontrol element as primary element the situation is reversed.

4. A control valve as in claim 2 there being one additional output duct receiving operating pressure whenever any of the two precontrol valves is controlled as secondary control valve.

5. Hydraulic control valve comprising:

a housing having a cylindrical bore;

a valve slide element disposed in the bore having three more centrally positioned control ridges, said bore having annular grooves radially aligned with said control ridges of said slide element when in a central position;

duct means for providing a first pressure to a middle one of the three annular grooves;

duct means for providing a second pressure being different from the first pressure to the other ones of the three annular grooves;

a pair of spring means acting upon opposite ends of the slide element tending to position it into a central and neutral position;

a further ridge near each of the ends and cooperating with a wider groove respectively adjacent said ends and being provided in said bore, an end ridge for each of the two ends of the slide element being constructed as a piston;

an additional relatively narrow bore adjacent each of said end ridges;

a pair of output ducts in the housing positioned to be selectively in communication with the middle one of said annular grooves or with one of the two other ones of said more centrally positioned annular grooves, the selection depending upon displacement in one direction or the opposite one of the slide element within bore;

further duct means including a pair of precontrol valves for respectively applying the higher one of the two pressures to said wider grooves, there being additional duct means in said slide element for transmitting such pressure when applied to thereby cause the slide element to be shifted into the one or the opposite position, the respective other annular groove serving as venting duct, there being additional duct means accordingly; and an additional output duct connected to receive pressure as applied via one of said precontrol valves and the respective wider groove whenever the respective other precontrol valve has been activated earlier for shifting the slide element into deflected position.

6. Hydraulic control valve as in claim 5 there being a further output duct connected to receive pressure when the sequence of activation of said precontrol valve is reversed.

7. Hydraulic control valve as in claim 5 wherein the outer ones of said more centrally disposed annular grooves are narrower there being an additional groove cooperating with the respective one of said more centrally disposed ridges and being connected to said other precontrol valve to cause operating pressure to be applied to said additional duct whenever the sequence of energization of said precontrol valves is reversed.

* * * * *